US006385510B1

(12) United States Patent
Hoog et al.

(10) Patent No.: US 6,385,510 B1
(45) Date of Patent: May 7, 2002

(54) HVAC REMOTE MONITORING SYSTEM

(76) Inventors: Klaus D. Hoog, 914 Dacian Ave., Durham, NC (US) 27701-1702; Nims P. Knobloch, Jr., 1202 Transcontinental Dr., Metairle, LA (US) 70001

( * ) Notice: Subject to any disclaimer, the term of this patent is extended or adjusted under 35 U.S.C. 154(b) by 0 days.

(21) Appl. No.: 09/203,728

(22) Filed: Dec. 2, 1998

Related U.S. Application Data

(60) Provisional application No. 60/067,793, filed on Dec. 3, 1997.

(51) Int. Cl.[7] ..... G01M 1/38

(52) U.S. Cl. ..... 700/276; 700/204; 700/300; 379/102.05

(58) Field of Search ..... 700/276, 278, 700/108; 379/102.05

(56) References Cited

U.S. PATENT DOCUMENTS

| | | | | |
|---|---|---|---|---|
| 4,432,232 A | | 2/1984 | Brantley et al. | 62/129 |
| 4,611,470 A | | 9/1986 | Enstrom | 62/127 |
| 4,897,798 A | | 1/1990 | Cler | 364/505 |
| 5,259,553 A | | 11/1993 | Shyu | 236/49.3 |
| 5,386,461 A | | 1/1995 | Gedney | 379/102 |
| 5,592,058 A | * | 1/1997 | Archer et al. | 318/254 |
| 5,682,329 A | * | 10/1997 | Seem et al. | 700/276 |

* cited by examiner

*Primary Examiner*—William Grant
*Assistant Examiner*—Ronald D Hartman, Jr.
(74) *Attorney, Agent, or Firm*—Marianne Fuierer; Steven J. Hultquist

(57) ABSTRACT

An electronic HVAC monitoring computer continuously monitors the general condition and efficiency of an HVAC system and notifies a central station computer via modem link or other signal transmission means, when the general condition or efficiency of the HVAC system falls below certain industry standard values by a pre-set amount.

22 Claims, 7 Drawing Sheets

HVAC REMOTE MONITORING SYSTEM

CROSS-REFERENCE TO RELATED APPLICATION

The priority of U.S. provisional patent application No. 60/067,793 filed Dec. 3, 1997 is hereby claimed.

BACKGROUND OF THE INVENTION

1. Field Of The Invention

This invention relates to the field of heating, ventilation and air conditioning (HVAC) monitoring devices and, more particularly, to an apparatus and method for continuously monitoring the performance of a residential or light commercial HVAC systems by comparing the performance of the monitored system to the performance of an ideal industry standard system of identical size and capacity. If the performance of the system being monitored deviates from the performance of the ideal system by more than a pre-set amount, then an operator may be alerted by various means including an alarm signal sent via a modem or other signal transmission means.

2. Description of the Related Art

Actual field surveys have shown that most HVAC systems tested are operating below the manufacturer's specifications. A small deviation from those specifications can mean a large increase in energy consumption. For example, a 10% undercharge in a system can mean the loss of almost two Seasonal Energy Efficiency Ratio (SEER) rating points, and a 23% undercharge can mean a 52% loss of efficiency.

To keep their units operating at peak efficiency, homeowners are urged by their system manufacturers and their contractors to schedule regular system maintenance. A standard maintenance call includes changing all filters, checking coolant levels and recharging, if necessary, cleaning coils and heat transfer surfaces, and making sure all air flow is unobstructed and free from dirt, foliage, etc.

There are a number of problems with regularly scheduled maintenance alone. If the coolant levels are correct, the filters are clean, and there are not other problems, the maintenance call may not have been necessary. This results in unnecessary expense and inconvenience for the homeowner. If system maintenance has just been performed, a leak may develop, or a component may malfunction shortly after the maintenance call. Unless the problem is severe enough to cause a complete system breakdown, the problem may not be noticeable to the homeowner for up to a year or until the next scheduled tune-up. This could result in ever increasing utility bills for the homeowner, and it could result in permanent damage to the HVAC system, severely shortening its life expectancy.

Performance monitors designed to address this problem use sensors to measure the difference between the HVAC system's return (intake) air stream temperature and the supply (exhaust) air stream temperature. This temperature difference, called "Delta T" (D/T or ΔT), is the best indicator of system performance. For one type of performance monitor the contractor installs the sensors in the appropriate ducts and connects the monitor to the thermostat so that it can determine whether the HVAC system is set to heat, cool, or idle. The contractor then enters the high and low heat ΔT limits into the monitor and then the high and low cool ΔT limits. When the HVAC system exceeds any of these ΔT limits an alarm is sounded. These alarms can take the form of a flashing light or sounding buzzer to alert the homeowner, or a phone connection with dialer apparatus can send a recorded voice message to the contractor.

The problem with this type of monitor is that it is dependent on input from the installer to determine the proper ΔT range. The correct ΔT range is determined by many factors and the installer would need to have a great deal of experience to gauge the system's potential performance correctly. This is especially true if the system is of a "mix & match" variety with components from different manufacturers. Other problems occur if the components are all from the same manufacturer but of different ages, or if a new system has been installed and joined to an older, undersized or oversized duct network.

Another type of performance monitor was developed to overcome some of these obstacles. This type of monitor directly measures the ΔT on a newly tuned or installed HVAC system that has been running for several minutes or long enough to have reached operating temperatures. This measurement is then considered the indicator of 100% performance efficiency of the HVAC system. As the performance degrades from the preset level to an unacceptable amount, e.g. 60% of ideal, then the monitor would sound an alarm.

The problem with this type of monitor is that if the HVAC system was initially installed incorrectly, the subsequent monitoring and measurements become meaningless. An additional inherent problem with the previous designs, and the main problem with existing performance monitors, is that they do not take into account the dynamic nature of the ΔT values. The ΔT is a number that is constantly changing over time. It is dependent not only on the temperature of the incoming air, but it is even more dependent on the relative humidity of the incoming air. If, for example, an HVAC unit, having a given CFM/Tonnage rating for cooling, has a return air temperature of 75° F. and return air relative humidity of 25%, the operating ΔT should be 24° F.; however, for the same sized unit and same temperature conditions, but a return air relative humidity of 80%, the operating ΔT drops to only 11° F.

An additional inconvenience for the contractor or installer responding to an alert signal is not knowing what the problem could be until the HVAC unit in question or the actual performance monitor installed at the customer's house can be examined. This can lead to delays, inconvenience, and loss if the correct parts or supplies do not arrive at the job site.

Existing performance monitors, once tripped, must all be reset manually. Even if the contractor knows the problem is temporary and will clear up on its own, someone must physically reset the monitor every time an alarm is sent. Again, this causes inconvenience for the home owner and a loss for the contractor.

Current HVAC performance monitor designs require highly skilled and experience technicians to set up the monitors. Current monitors ignore the effects of humidity of ΔT. Currently monitors can't compare the performance of the HVAC system they are monitoring to the system's nominal performance as published by the manufacturer. Current monitors do not relay specific information to the contractor's office to aid in diagnosing problems. Current monitors must be reset manually.

U.S. Pat. No. 4,611,470, issued Sep. 16, 1998 to Henrik S. Enstrom for "Method primarily for performance control at heat pumps or refrigerating installations and arrangement for carrying out the method," describes a method of primarily testing and performance controlling heat pumps, refrigerating installations or corresponding systems, in which the system performance is measured and compared to electrical energy input. This methodology has the disadvantage that it requires the electric input to be measured directly to determine if the system is running efficiently.

U.S. Pat. No. 4,432,232, issued on Feb. 21, 1984 to Vanston R. Brantley, et al. for "Device and method for measuring the coefficient of performance of a heat pump," describes a system for quick and accurate measurement of the coefficient of performance of an installed electrically powered heat pump including auxiliary resistance heaters.

Temperature sensitive resistors are placed in the return and supply air ducts to measure the temperature increase of the air across the refrigerant and resistive heating elements of the system. The voltages across the resistors are proportional to the respective duct temperatures. These voltages are applied to the inputs of a differential amplifier and a voltage-to-frequency converter is connected to the output of the amplifier to convert the voltage signal to a proportional frequency signal. An input power frequency signal is produced by a digital watt meter arranged to measure the power to the unit. A digital logic circuit ratios the temperature difference signal and the electric power input signal to produce a coefficient of performance of the system. This coefficient of performance determination method and associated apparatus have the significant deficiency that the effects of humidity, which often have enormous impact on system performance, are wholly ignored. As a result, the coefficient determined for the heating system by the method and apparatus of the Brantley et al. patent may be grossly in error, with respect to the effects of relative humidity.

It is therefore an object of the present invention to provide an efficient means and method for determining ideal operating performance levels of an HVAC unit, e.g., a residential or light commercial HVAC unit, and monitoring its performance level.

It is another object of the present invention to provide means for measuring the change in performance and telemetering monitoring data of an HVAC unit to a central computer station so that a repair and maintenance recommendation may be made for the HVAC unit.

It is yet another object of the present invention to provide a facile means of maintaining an optimum performance level of a HVAC unit in an quick, energy-efficient and economical manner.

It is a still further object of the invention to provide a means and method for monitoring and maintaining optimum performance of a thermal management system such as a HVAC unit, that overcomes the deficiencies of the prior art.

Other objects and advantages of the invention will be more fully apparent from the ensuing disclosure and appended claims.

SUMMARY OF THE INVENTION

The present invention relates to an apparatus and method for continuously monitoring the performance of a HVAC system, e.g., a residential or light commercial HVAC system, by comparing the performance of the monitored system to the performance of an ideal industry standard system of identical size and capacity. If the performance of the system being monitored deviates from the performance of the ideal system by more than a pre-set amount, then a monitoring report can be generated and/or an operator may be alerted by various means including an alarm signal sent via a modem or other signal transmission means, and/or adjustment action can be initiated by suitable adjustment means incorporated in the system.

The present invention overcomes the problems of prior art monitoring and control systems, by directly measuring the return (intake) air relative humidity as well as the return and supply (exhaust) air temperatures. It is not necessary to measure the supply air relative humidity, because performance efficiency of standard HVAC units is not typically related to supply air relative humidity levels. The installer of the monitor needs to know only the specification of the HVAC system being installed. The installer must know the tonnage rating of the air conditioning unit and the CFM rating of the air handler to calibrate the system for cooling mode. For heat mode, the installer needs to know the CFM rating of the air handler, whether the furnace is electric or gas/fuel powered, and the size of the heater in kW or BTU capacity.

When the monitor is being calibrated, the sensor inputs are compared to optimum values for an HVAC system of the size and capacity being monitored by means of industry standard tables and equations. This comparison yields a "correction factor" which shows how close best actual system performance is to theoretical ideal system performance. If the correction factor is too large, it indicates an improper installation or faulty component which needs to be replaced.

Once the monitor has been calibrated, the sensors take readings periodically as long as the thermostat is calling for heat or cool. The monitor examines the return air temperature and humidity, calculates the $\Delta T$ based on those readings, and offsets that $\Delta T$ value by the correction factor. This yields the calculated $\Delta T$ value. If the actual $\Delta T$ varies from the calculated $\Delta T$ by more than an established tolerance, then the monitor transmits an alarm to a central station via a suitable communication means such as for example a computer modem, facsimile, wireless transmission, direct hard-wire connection etc.

A central station downloads the telemetry data from the remote monitor and generates a complete report showing temperature and humidity data, thermostat settings, details of the problem, and details of the size, type, and capacity of the HVAC system. This report is then transmitted to the contractor responsible for the maintenance of that system giving him enough information to begin diagnosing the problem. As with the telemetry of data from the HVAC unit, the report may also be sent to the contractor via computer modem, facsimile, wireless transmission, direct hard wire connection, etc.

If the contractor needs to make repairs on the HVAC unit, he can manually reset the monitor when the repairs are completed. If the problem is something minor like a dirty filter, the contractor can simply call the homeowner to remind him to change the filter. The monitor will reset itself automatically after a programmed time, e.g., 18 hours.

These features overcome the problems inherent in previous HVAC performance monitors and enable contractors to maintain their customers' equipment at optimum levels. This furthermore allows homeowners to save money on energy and repair bills.

Other features, aspects and embodiments of the invention will be more fully apparent from the ensuing disclosure and appended claims.

DETAILED DESCRIPTION OF THE INVENTION, AND PREFERRED EMBODIMENTS THEREOF

Figure 1:
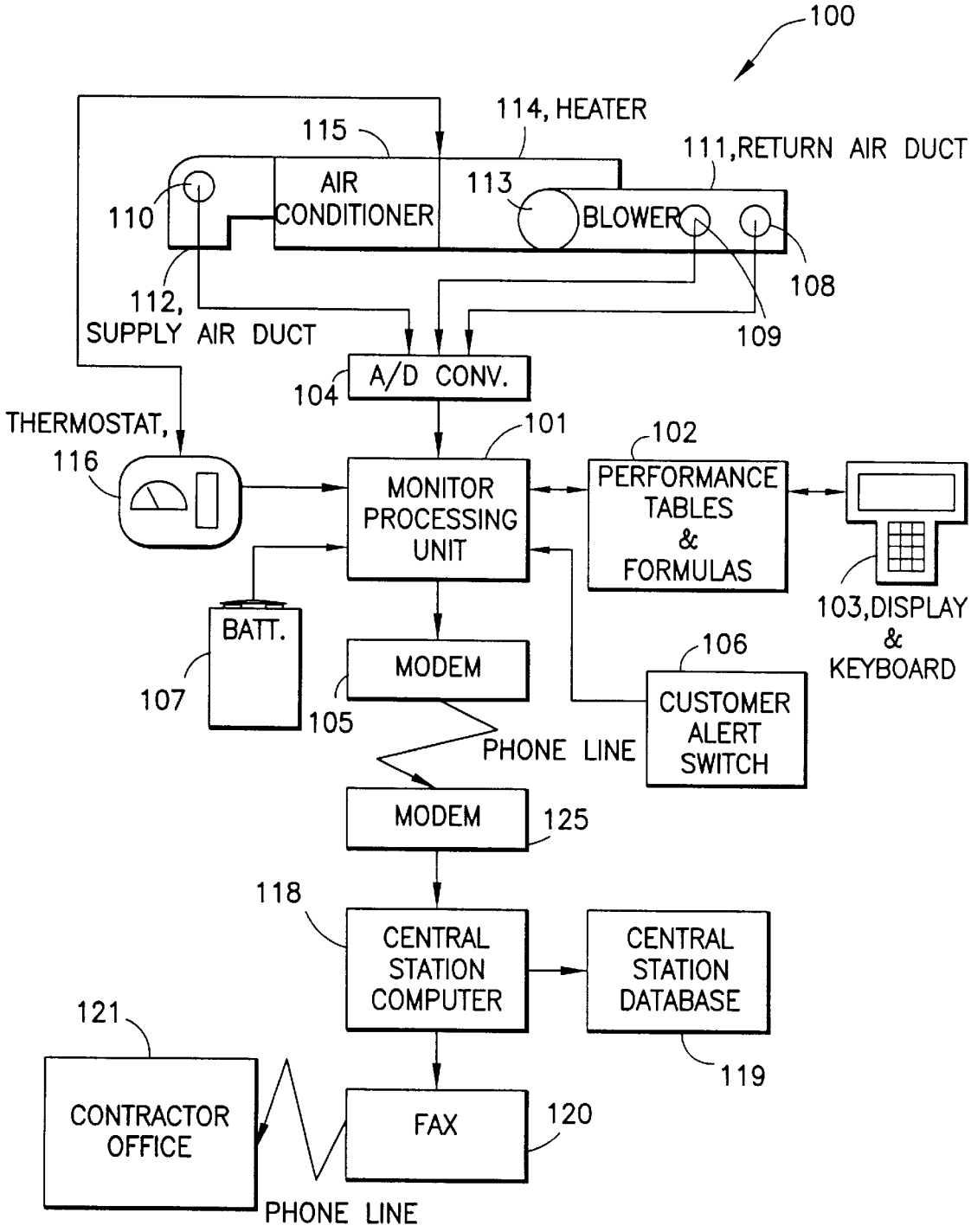
FIG. 1 is a block flow diagram showing various components of the HVAC monitoring unit and system operations.

An HVAC monitoring system in accordance with one embodiment of the invention is illustrated in the block diagram shown in FIG. 1. This illustrative system comprises three basic units including the HVAC unit 100, a monitor processing unit 101 and the central computer station 118. The preferred embodiment of the monitor processing unit 101 contains a microprocessor with memory for analyzing input readings and is located inside the home or building where the HVAC unit 100 is to be monitored. The monitor processing unit 101 may be comprised of other suitable electrical and/or mechanical means necessary to monitor and process input data. Such processing means may take the form of a central processing unit or variant microelectronic circuitry.

The input elements to the monitor processing unit 101 include an analog-to-digital (A/D) converter 104 that converts analog environmental readings from the HVAC supply air duct 112 and the return air duct 111 and converts them to a digital outputs readable by the monitor processing unit 101. The monitor processing unit 101 is also linked to the unit thermostat 116 and processes the real-time input data against the calibration measurements initially established by the input of performance tables & formulas 102 through the display and keyboard 103. Although the preferred embodiment discloses keyboard 103 for inputting data into the monitor processing unit 101, other input devices would be applicable for this purpose including voice interface devices and other audio and/or visual sensory input devices. The performance tables and formulas 102 are stored within the memory of the microprocessor of the monitor processing unit 101.

During initial installation in a house or building, the HVAC unit 100 is tuned up to its optimum levels as determined by the installing technician. The return air temperature monitor 108 and return relative humidity monitor 109 are physically installed proximate the return air duct 111. The supply air temperature sensor 110 is installed near the supply air duct 112. The technician uses the data entry display and keyboard 103 to enter basic information about the HVAC unit 100 into the monitor processing unit 101. This information consists of an identifier so the central station 118 can tell which monitor processing unit 101 and HVAC unit 100 it is dealing with, fan CFM per ton of rated capacity for the air conditioner 115 and type of furnace (electric, gas, or fuel), rated efficiency for gas or fuel, and total system CFM for the heater 114. The HVAC unit 100 is then turned on for a sufficient amount of time to achieve operating temperatures. The monitor processing unit 101 is then set to calibration mode.

The return air temperature sensor 108 and the return air humidity sensor 109 are mounted in the return air duct 111 of the HVAC unit 100 to measure the characteristics of the air entering the heating and cooling elements. The supply air temperature sensor 110 is mounted in the HVAC supply air duct 112 to measure the temperature of the air after is has been modified by the heating and cooling element of the HVAC unit 100.

The temperature of the supply air for a given return air temperature and humidity is the best indicator of the HVAC unit's performance. To be meaningful, however, the performance has to be compared to standard performance values for the size and type of HVAC unit being monitored. The information gathered by the sensors 108 to 110 is changed to digital form by the analog to digital (A/D) converter 104 and then sent to the monitor processing unit 101.

The monitor processing unit 101 compares this information to the inputted performance tables and formulas 102. If the HVAC control element or thermostat 116 is calling for cooling the monitor uses ΔT air conditioning tables that calculate the ideal temperature differentials based upon a given return air temperature and a given return air relative humidity reading.

Figure 3A:
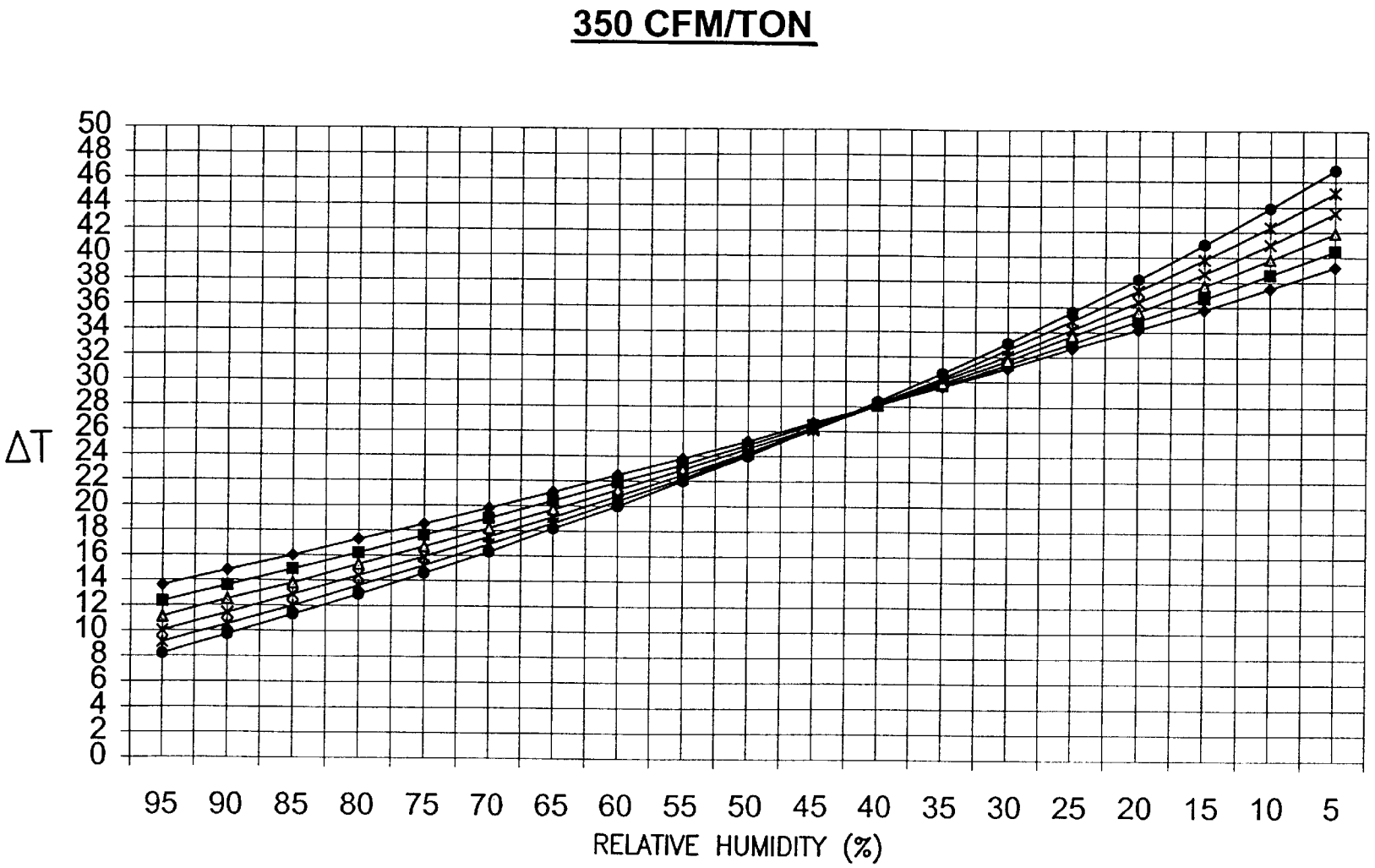
FIG. 3*a* corresponds to Table 1*a*, and is a graphic depiction of ideal temperature differential ratings under cooling conditions for a given return air relative humidity and temperature level for a 350 CFM/Ton unit.
Figure 3B:
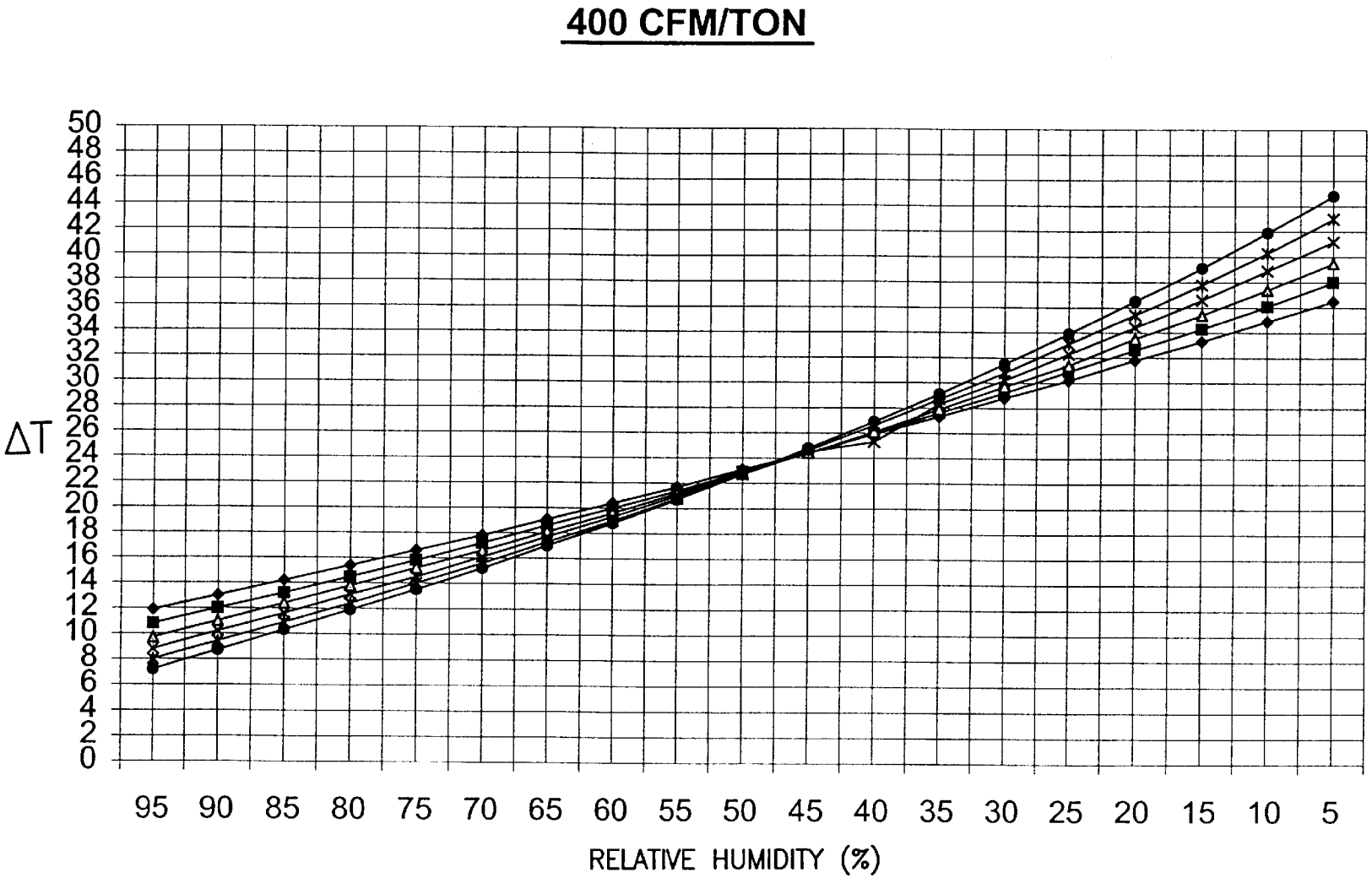
FIG. 3*b* corresponds to Table 1*b*, and is a graphic depiction of ideal temperature differential ratings under cooling conditions for a given return air relative humidity and temperature level for a 400 CFM/Ton unit.
Figure 3C:
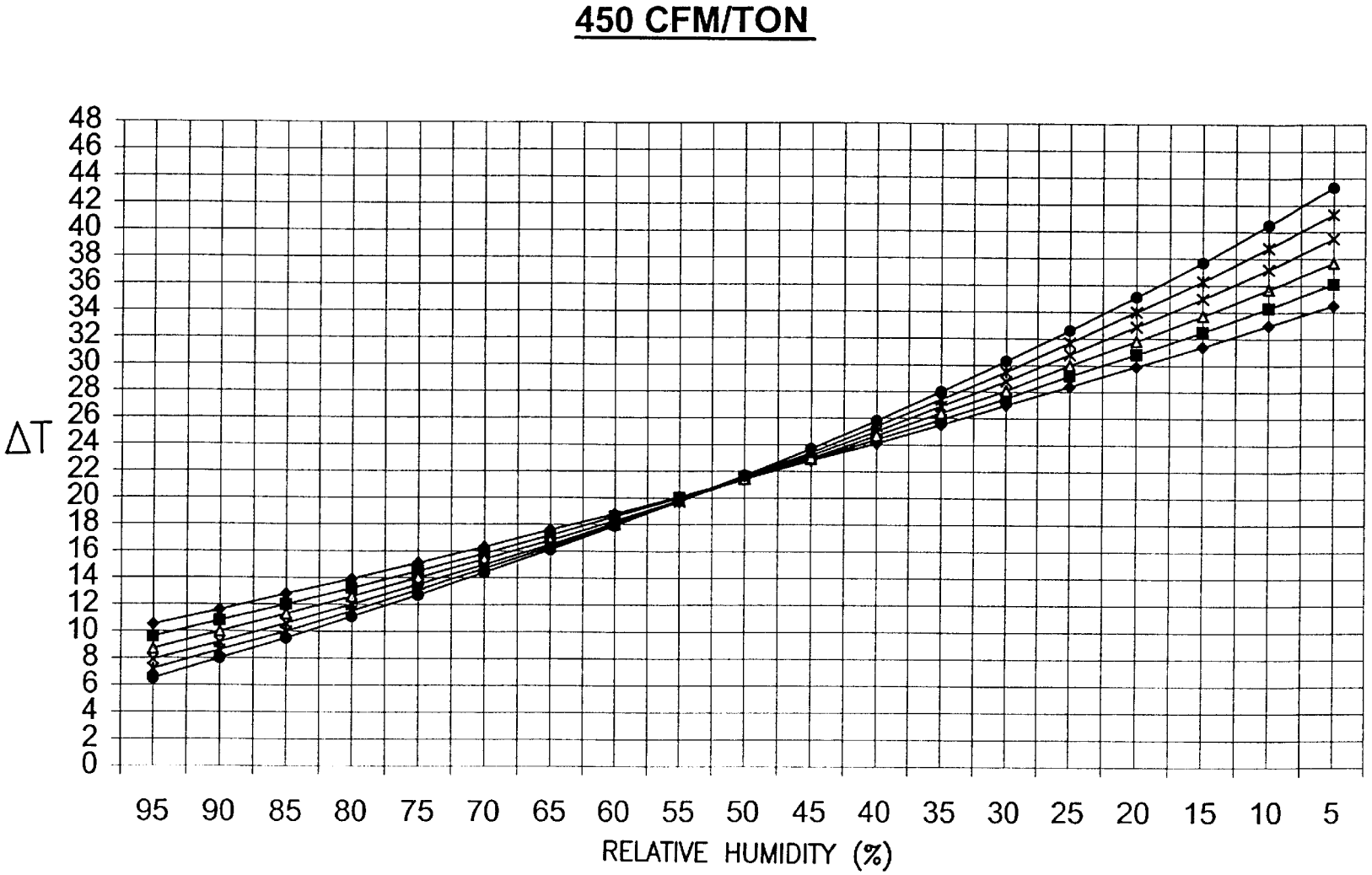
FIG. 3*c* corresponds to Table 1*c*, and is a graphic depiction of ideal temperature differential ratings under cooling conditions for a given return air relative humidity and temperature level for a 450 CFM/Ton unit.
Figure 1:
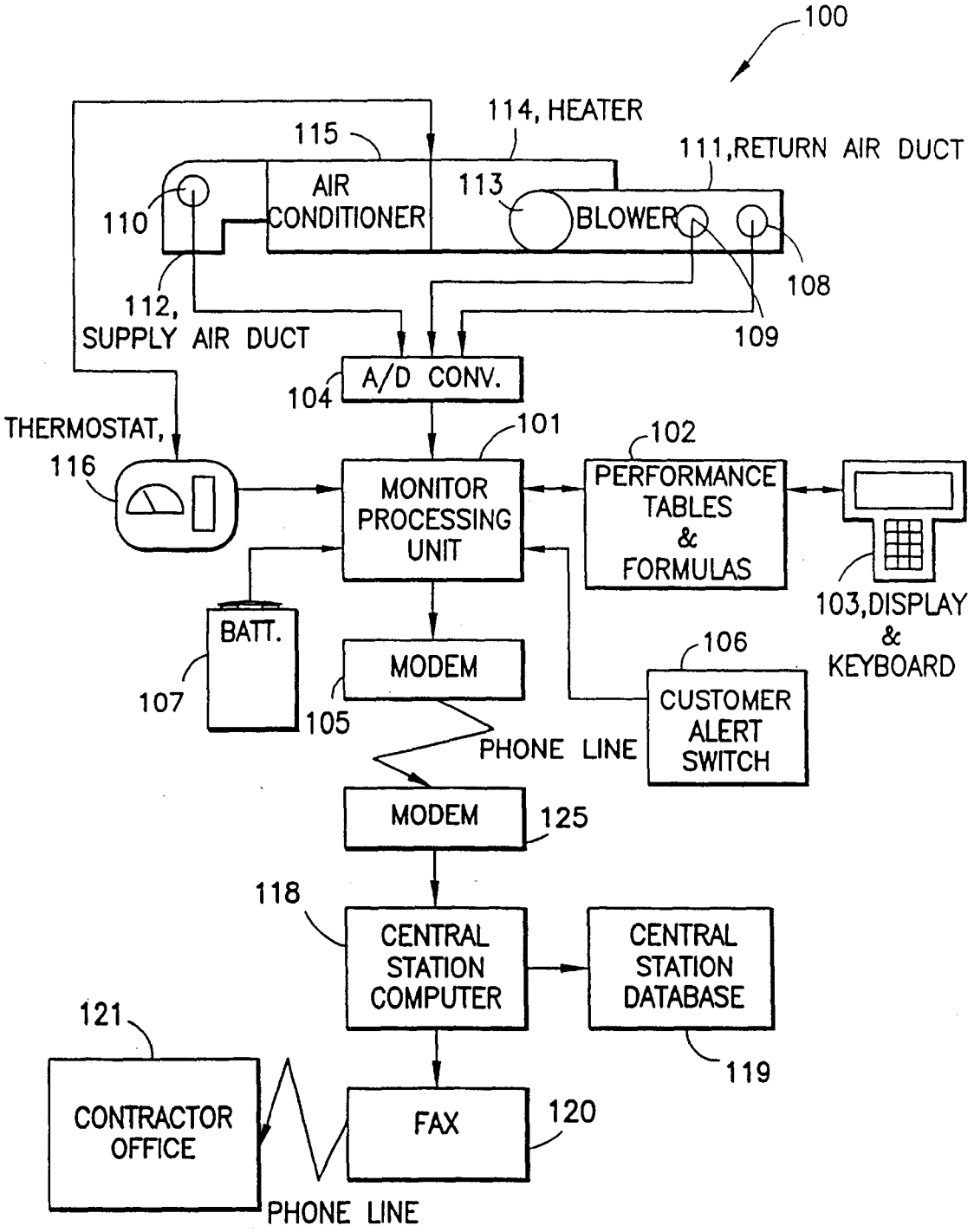
Figure 2A:
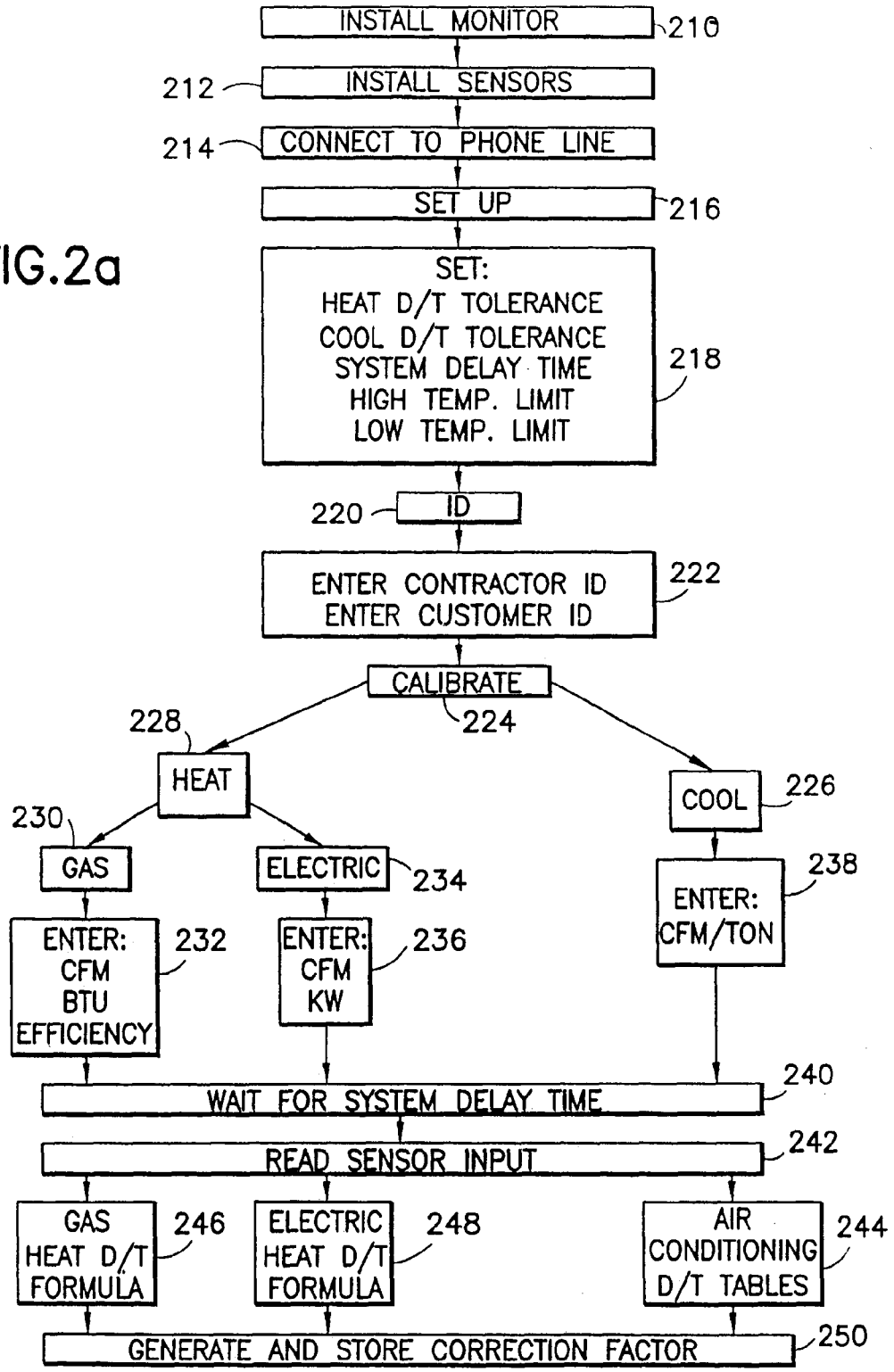
Figure 2B:
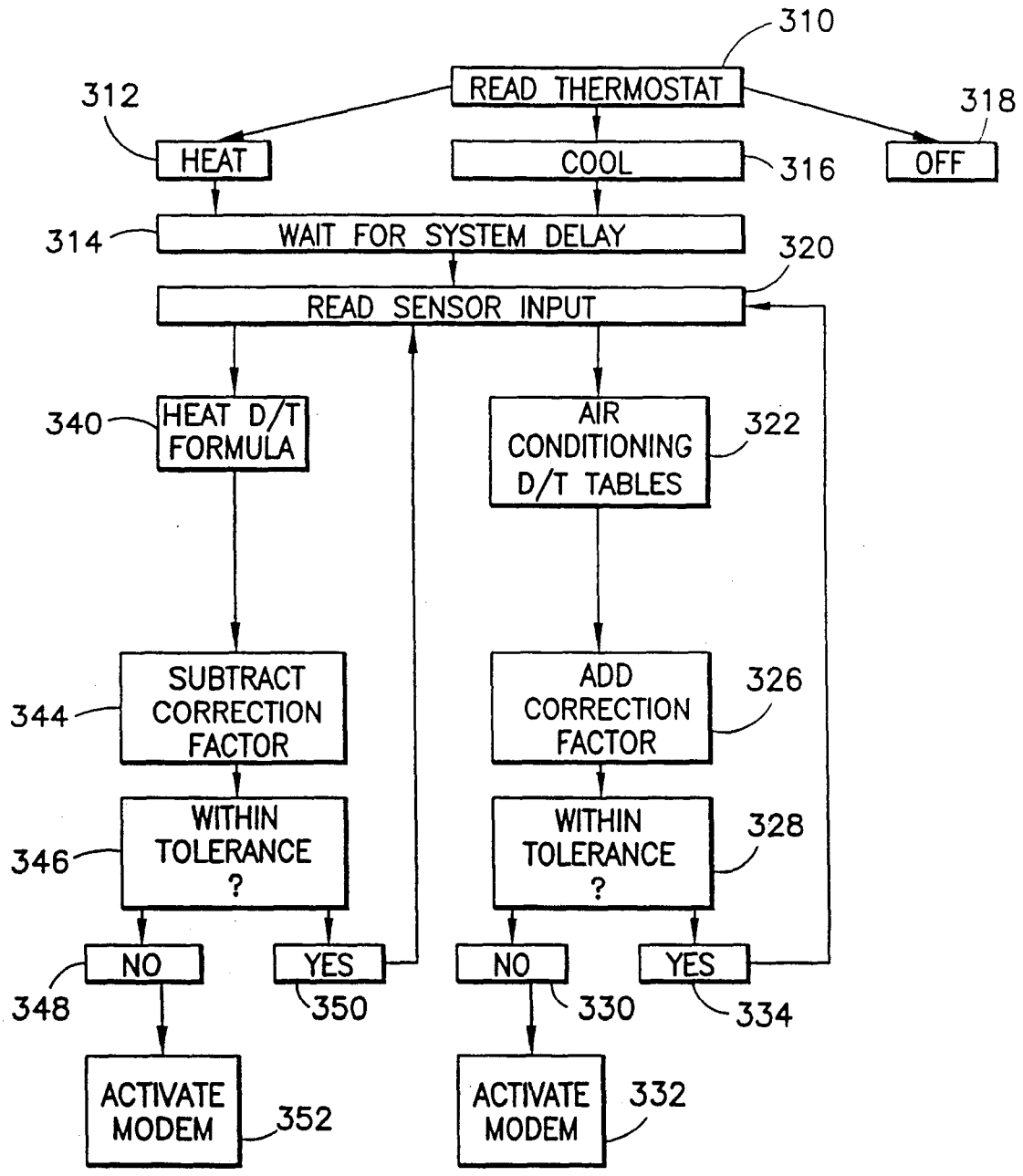
Figure 2C:
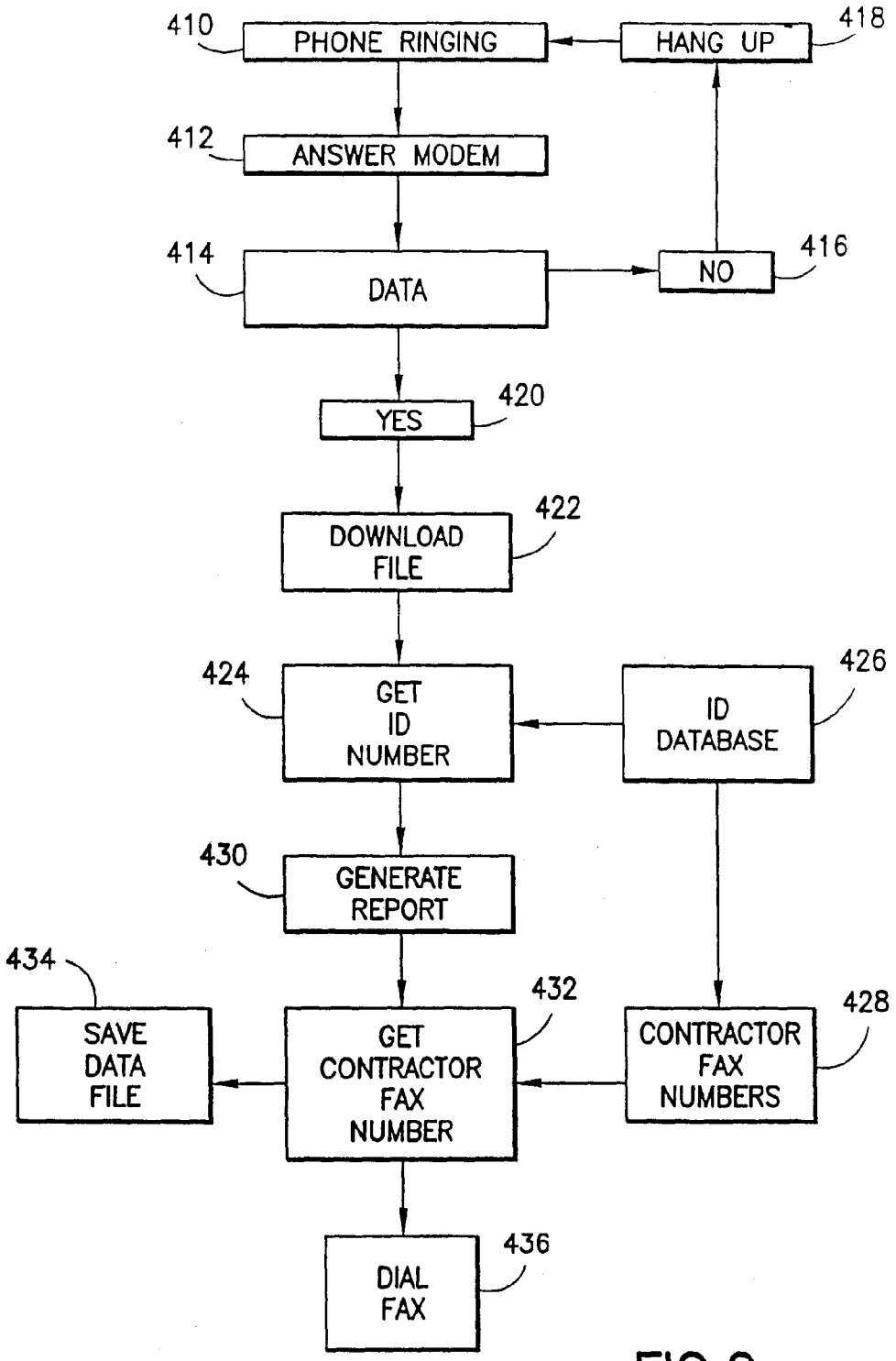
Figure 3A:
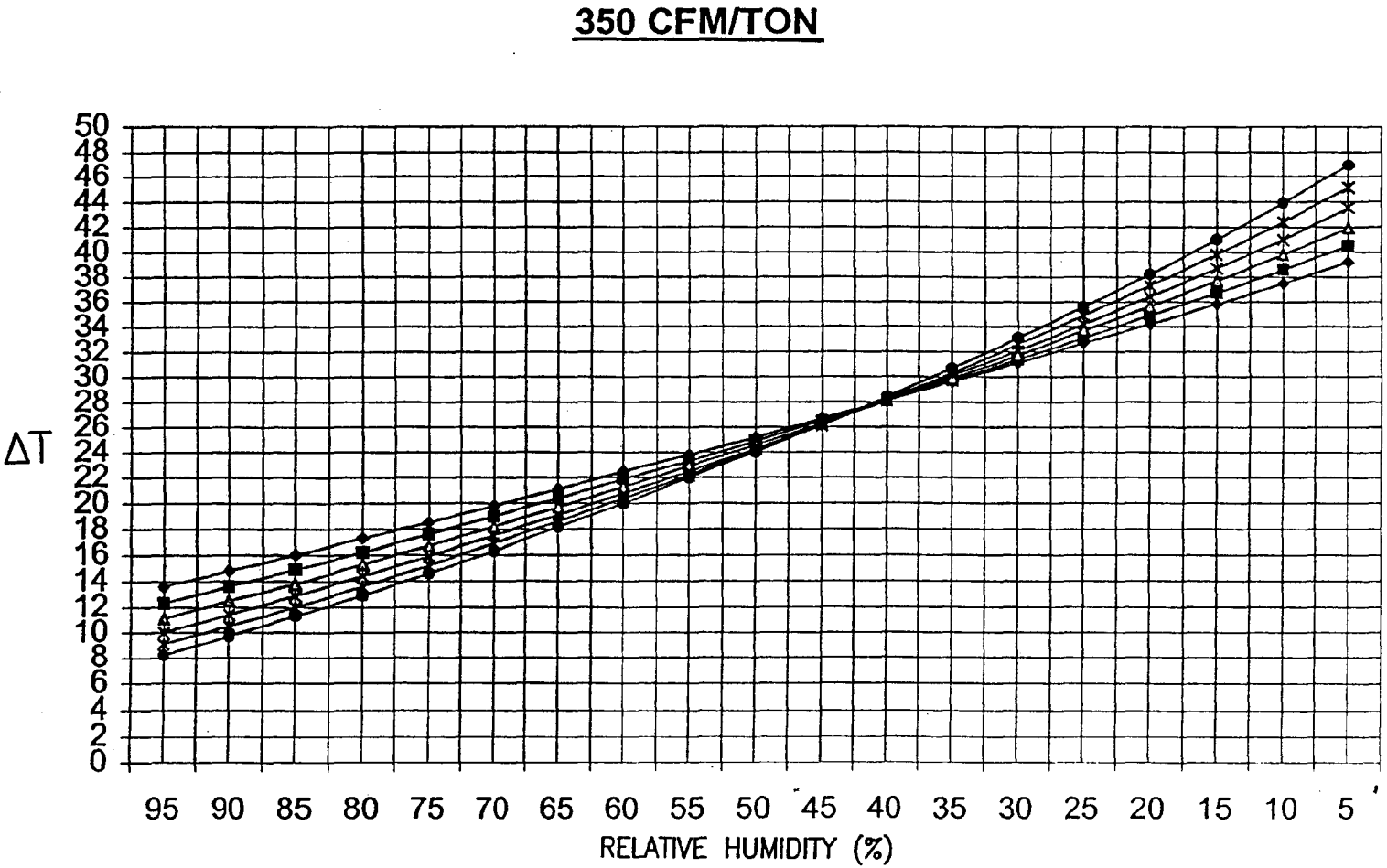
Figure 3B:
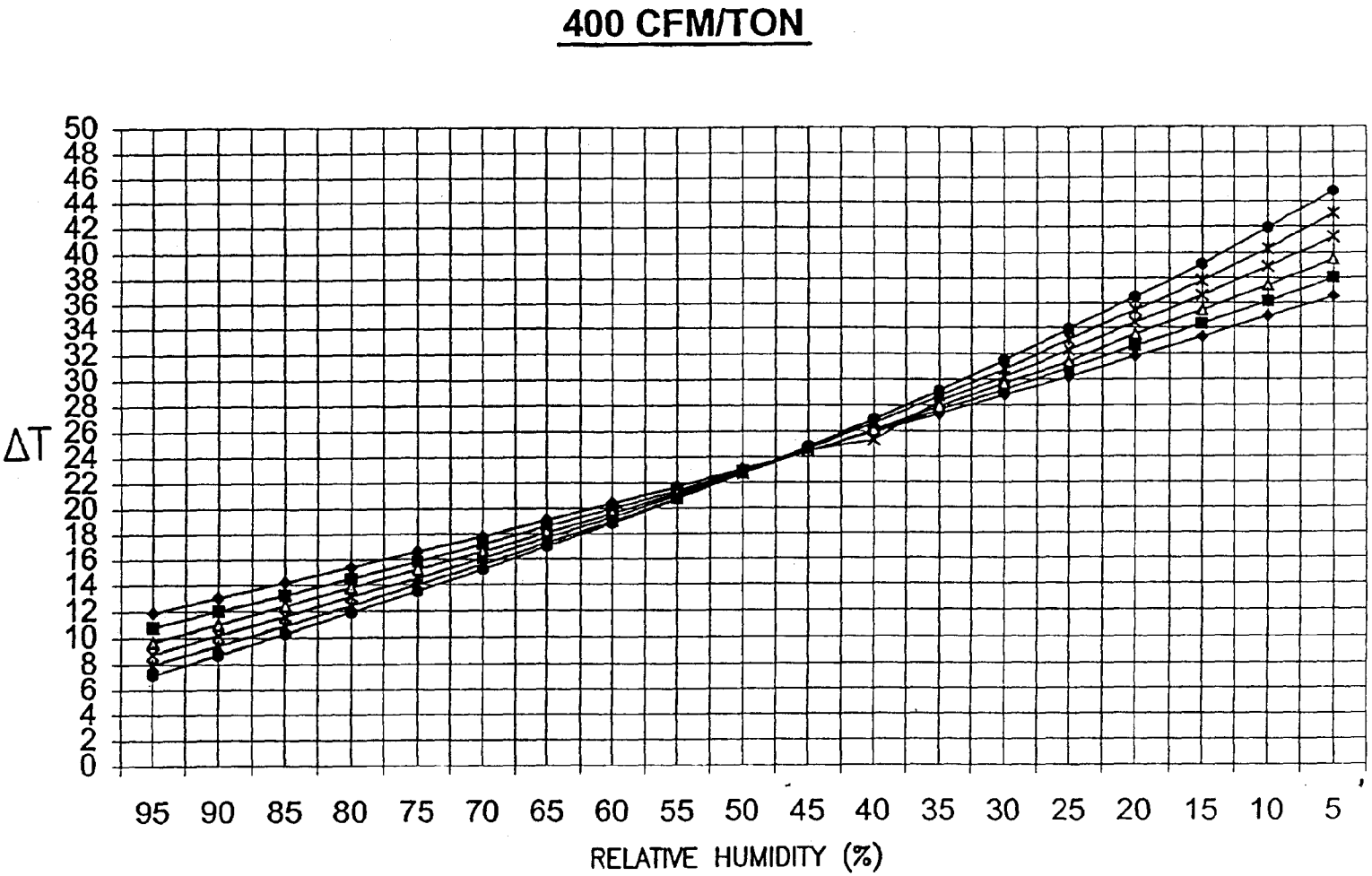
Figure 3C:
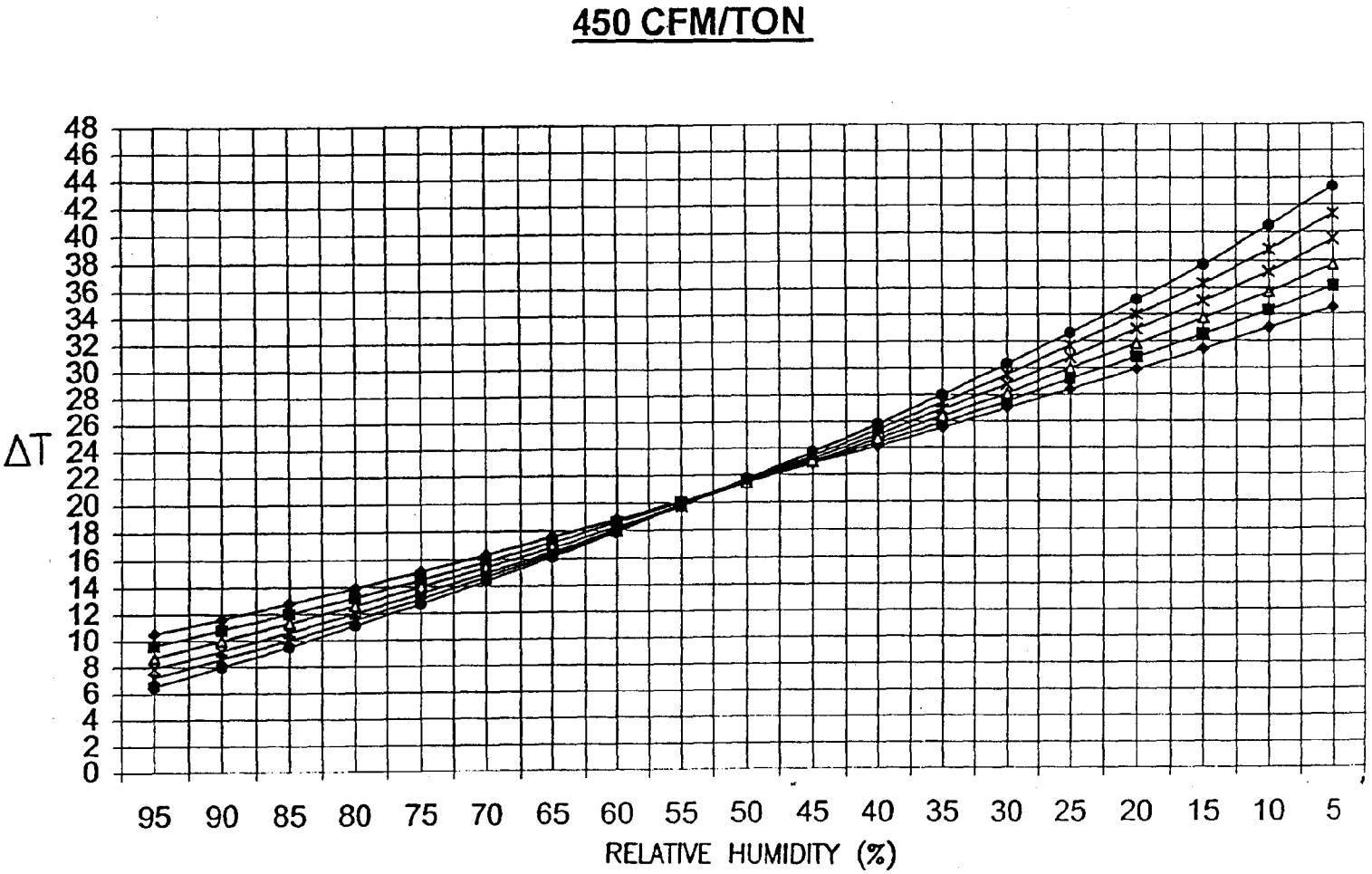

Tables 1*a*, 1*b*, and 1*c* represent ideal temperature differential outputs for a given return air temperature and return air relative humidity based upon a CFM capacity per air conditioning tonnage rating. FIGS. 3*a*, 3*b* and 3*c* are the graphic representations of Tables 1*a*, 1*b* and 1*c* showing the linear function of ideal temperature differential verses relative humidity for a given return air temperature in degrees Fahrenheit.

If the thermostat 116 is calling for heat, and the furnace is electric, then the monitor will use the formula:

$$\Delta T=(kW\times 3193)/CFM$$

Where ΔT is the temperature difference between the return air and the supply air in degrees Fahrenheit, kW is the furnace capacity in kilo-Watts, and CFM is the capacity of the fan in cubic feet of air per minute. This determines the correct ΔT for an electric system of the type and size being monitored. If the furnace is gas or fuel powered, then the formula used is:

$$\Delta T=(BTU)\ (EFF)/(CFM)\ (1.08)$$

Where ΔT is the temperature difference between the return air and the supply air in degrees Fahrenheit, BTU is the furnace capacity in British thermal units, EFF is the efficiency rating of the furnace in percentage, and CFM is the capacity of the fan in cubic feet of air per minute. This determines the correct ΔT for a gas or fuel system of the type and size being monitored.

The ΔT obtained from the appropriate formula or table is then compared to the actual sensor readings. The difference is degrees Fahrenheit between the formula or table ΔT and the actual sensor derived ΔT is the correction factor. This correction factor is stored with the tables and formulas 102, and is referred to during all subsequent readings. Calibration must be run with the thermostat 116 set to heat and again with the thermostat 116 set to cool. This will generate a cool correction factor to be applied when the HVAC unit 100 is cooling as well as a heat correction factor to be applied when the HVAC unit 100 is heating.

After running calibration mode, the HVAC unit 100 will be monitored whenever the thermostat 116 calls for heat or cool. The return air temperature sensor 108 and the return air humidity sensor 109, mounted in the return air duct 111 of the HVAC unit continuously measure the characteristics of the air entering the heating and cooling elements of the HVAC unit 100.

The supply air temperature sensor 110, mounted in the HVAC supply air duct 112, continuously measures the temperature of the air after it has been modified by the heating or cooling element of the HVAC unit 100. The information gathered by the sensors 108 to 110 is continuously changed to digital form by the analog to digital converter 104 and then sent to the monitor processing unit 101.

The monitor processing unit 101 examines the HVAC system performance tables or formulas 102 and determines the correct ΔT for the current temperature and humidity. It then adds the cool correction factor to this value if the thermostat 116 is calling for cool, or subtracts the heat correction factor from this value if the thermostat 116 is calling for heat.

The resulting value, the calibrated ΔT, should be very close to the actual ΔT as measured by the return air sensor 108 and supply air sensor 109. If the actual ΔT differs from the calibrated ΔT by more than five degrees Fahrenheit, or a desired amount, the monitor activates the modem 105 which is connected to the public telephone lines and uploads the sensor and set-up data including the monitor identifier to the central station computer 118. If the line is in use or if the central station line is busy, the monitor modem 105 will redial in 30 minutes.

The central station computer 118 interprets the data and generates a report which it then faxes to the contractor's office 121 using the central station fax 120. The report contains the set-up information, the sensor information, and actual and calculated ΔT values. In addition to this information, the central station also provides an analysis listing several possible causes for the problem. Some examples of this would be:

HVAC system is set to cool
Calculated ΔT=18
Actual ΔT=0
Diagnosis: Compressor not running
Possible causes: Power off to condenser, tripped fuse/breaker
Control wire broken, contractor open
Time delay relay defective
Compressor off due to internal overload
HVAC system is set to cool
Calculated ΔT=18
Actual ΔT=12
Diagnosis: Compressor running below capacity
Possible causes: System low on freon, possible leak
High head pressure, dirty condenser
Partial restriction on liquid side Self-test of the monitor is achieved by the monitor sending a report at a regular interval or other predetermined time, e.g., every month, even when no faults have been detected. The central station database 119 keeps track of all the monitor units in the field and flags those which have not checked in within the last 30 days.

Since the return air temperature sensor 108 monitors what is in effect the inside ambient temperature of the home or building, it can be set to send an alert when that temperature reaches a level that may indicate freezing. An alert can also be triggered if the temperature or the humidity (using the humidity sensor 109) in the house or building is too high. This alerting capability would warn of possible heat or humidity damage in areas where hot weather is common.

Battery back-up 107 for the monitor enables it to report power outages and main fuse or breaker tripping.

Means are provided to allow the homeowner to initiate a report using the Customer Alert Switch 106. If the homeowner is not feeling comfortable, he can initiate a call from the monitor to the central station when then faxes the contractor with the information about the homeowner's HVAC system.

Calibration

Figure 2A:
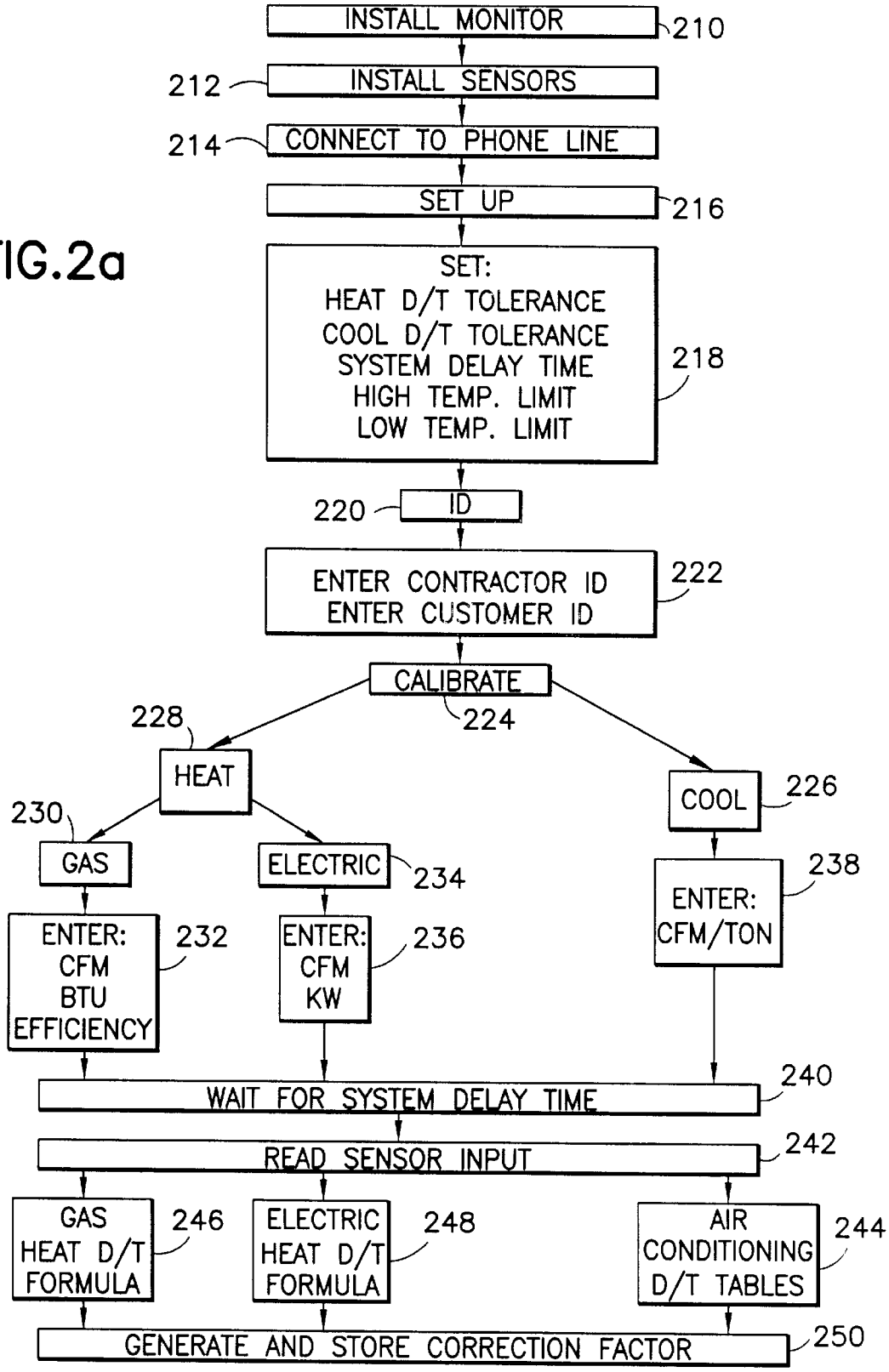
FIG. 2*a* is a block flow diagram showing the operations of the HVAC monitoring unit during initial system calibrations.

A flow diagram of the calibration procedure for initializing the HVAC monitoring system is shown in FIG. 2*a* of the drawings. The initial calibration steps include the steps necessary to install monitor 210, install sensors 212 and connect the phone line 214 to the monitor processing unit. The set-up 216 step includes the unit specification data entry and processing necessary to give the monitor processing unit the necessary data to accurately evaluate the performance of the unit. This data entry includes setting the heat and cool D/T tolerances, system delay times and high and low temperature limits 218 of the system. Before any data and information can be telemetered to a remote location for evaluation, a unit ID 220 must be set-up and corresponding contractor and customer ID 222 entered.

Once the contractor and customer ID 222 is entered, the operator must calibrate 224 the HVAC unit for heat 228 mode and cool 226 mode operations. When calibrating the heat 228 mode, a determination is made as to the use of a gas 230 or electric 234 heater. If using a gas 230 heater, the HVAC CFM, BTU and efficiency 232 values are entered into the monitor processing unit by means of keyboard entry. If the heat 228 is from an electric 234 source, the CFM and kW 236 rating must be entered into the monitor processing unit. If the cool 226 mode of the HVAC unit is being calibrated, the air conditioning CFM/Tonnage 238 rating is entered into the monitor processing unit.

The generation and storage of the correction factor 250 does not occur until their is a system delay time 240, and the processor reads the sensor input 242 and subsequently enters the theoretical ideal temperature differential values. For gas heat mode operation, the gas heat D/T formula 246 is calculated by the monitor processing unit. For electric heat mode operations, the electric heat D/T formula 248 is determined. Finally, for cool mode operations, the formula calculations derived from the air conditioning D/T tables is determined by the monitor processing unit.

Run-Time Monitoring

Figure 2B:
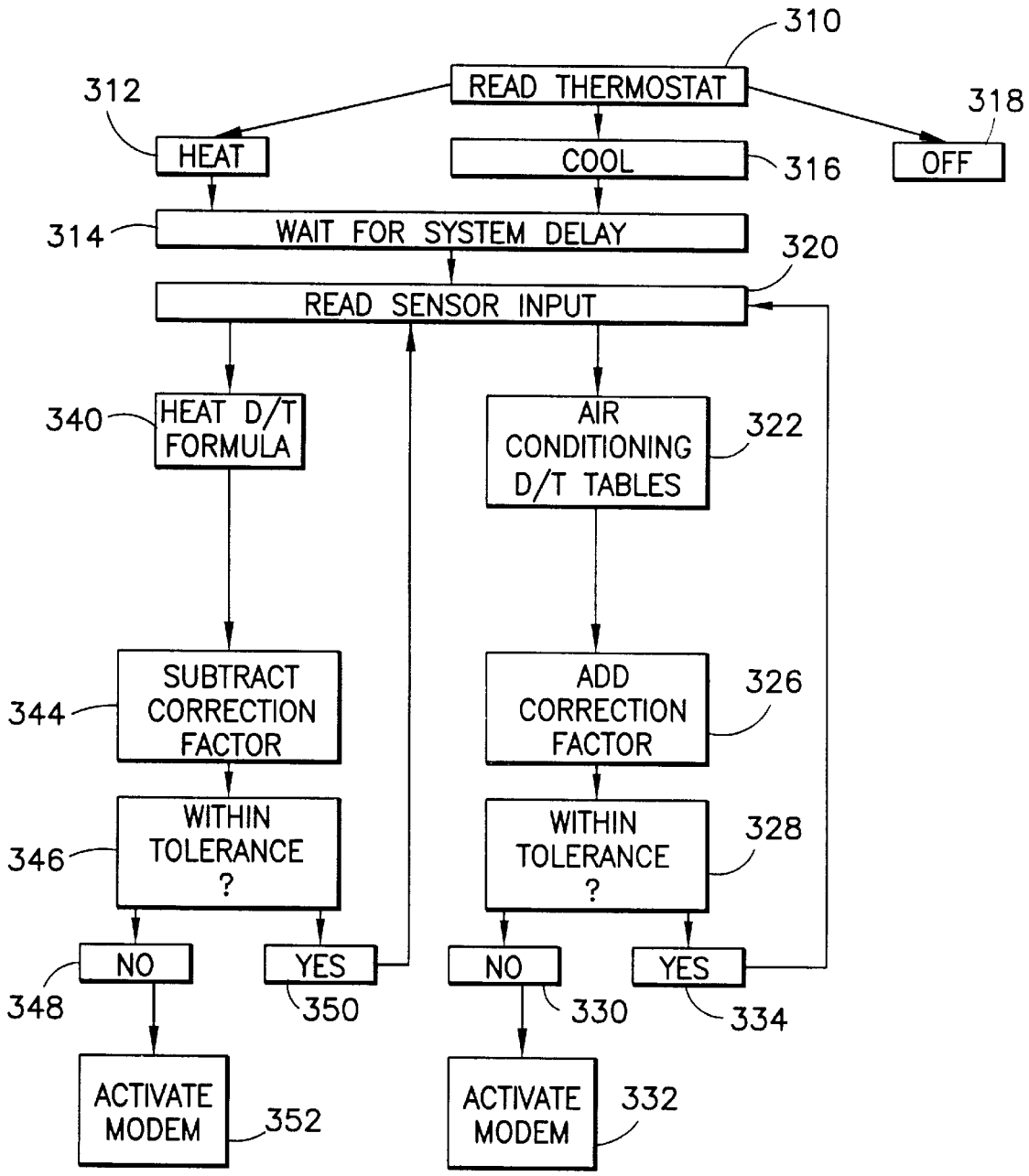
FIG. 2*b* is a block flow showing the operations of the local HVAC monitoring unit during normal operating conditions.

Referring to FIG. 2*b*, the system running operations are depicted. The system first reads the thermostat 310 and then identifies whether the HVAC unit is in heat 312, cool 316 or off 318 mode. If operating in the heat 312 or cool 316 mode, there is an initial system delay 314 and then the processing unit reads sensor input 320 from the temperature and relative humidity monitors.

When operating in the heat 312 mode, the monitor processing unit calculates the ideal temperature differential by using the heat D/T formulas 340 and then subtracts the correction factor 344. The processing unit must then determine whether the operating temperature differential is within tolerance 346. If the answer is yes 350 the system returns to read sensor input 320 mode. If, however, the answer is no 348, the system activates the modem 352, which telemeters relevant data, including identification information for the HVAC unit, customer and contractor, to a central station computer. Still referring to FIG. 2*b*, the air condition mode operations are conducted similarly to those of the heating mode. After the system reads sensor input 320 for real-time operating conditions, the formulas from the air conditioning D/T tables 322 are used to calculate the ideal temperature differential. After adding the correction factor 326 for a given return air temperature and return air relative humidity, the processing unit determines whether the actual temperature differential is within tolerance 328. If the answer is yes 334 the system returns to read sensor input 320 mode. If, however, the answer is no 330, the system activates the modem 332 which telemeters relevant data, including identification information for the HVAC unit, customer and contractor, to a central station computer.

Central Station

Figure 2C:
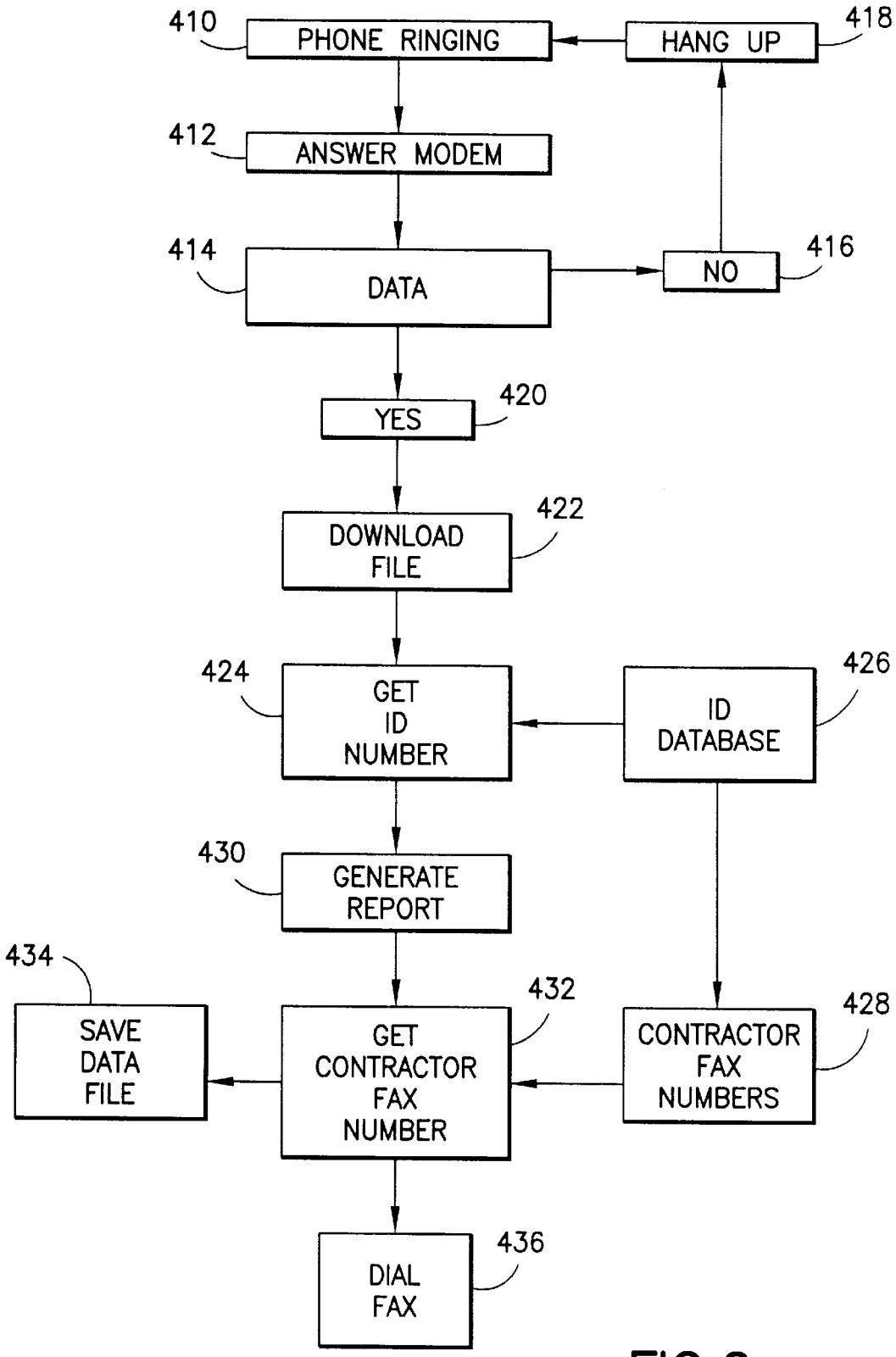
FIG. 2*c* is a block flow diagram showing the system operations that occur at the remote central station.

Referring to FIG. 2*c*, the operation of the central station for receiving telemeter data from the monitor processing unit is depicted. Performance data from the monitor processing unit is telemetered to the remote central station by means of computer modem communications. The first step is the phone ringing 410 which is answered by the modem 412. If data 414 is not being sent, no 416, the central station hangs up 418. If the answer to whether there is data 420 is yes 420, the computer downloads the file 422.

An ID number 424 is determined for the HVAC unit performing below a designated level and ID specific database 426 used to generate a report 430 providing recommendations based upon an analysis of the performance data telemetered from the HVAC unit. The ID specific database 426 contains the contractor fax numbers 428 for contractors located near the HVAC unit. The central station computer gets the contractor fax number 432 and dials the fax 436 to the contractor sending the performance result and repair and maintenance recommendations. Finally, the central station computer saves the data file 434.

Preferred Embodiment

The preferred embodiment of the invention includes one sensor assembly including a temperature sensor and a humidity sensor mounted in a housing suitable for installation in a return air duct, and a temperature sensor assembly mounted in a housing suitable for installation in a supply air duct. Both housings should position the sensors as close to the center of the ducts as possible. The sensors should be of a type easily interfaced to and readable by electronic instrumentation.

The sensor assemblies should be linked to a central single board computer using a plurality of cables or, alternatively, wireless transmitters and receivers or a line carrier means where the signals are transmitted over the house electric wiring. The single board computer should have means to amplify and condition the signals sent by the sensors in accordance with instructions furnished by the sensor manufacturer(s). The single board computer also requires a standard analog to digital conversation circuit for each sensor. These circuits can also be found in the manufacturer's data books. After the analog sensor signals have been converted to digital form, they can be read by any commercially available 8—bit microprocessor. The microprocessor circuit again follows the guidelines established by the manufacturer in the data books.

Power for the single board computer can be derived from the HVAC system's low voltage 24VAC transformer. This is available on virtually all standard HVAC systems and is used to power the relays or contractors that supply high voltage power to the various components of the HVAC system itself. These relays are switched on and off in their proper sequence by the HVAC system's thermostat. The 24VAC power must be rectified and reduced to 5VDC on the single board computer to supply power for the microprocessor and other components.

The single board computer must also interface with the thermostat to be able to determine what mode, off, fan, heat, or cool the HVAC system is in. The preferred wiring sequence for this would be as follows: connecting to the hot (usually red) wire coming from the thermostat and the common (usually black) wire coming from the 24VAC transformer will supply power to the single board computer. Connecting to the fan wire (usually green), the heat wire (usually white), and the cool wire (usually yellow) will allow the single board computer to monitor the HVAC modes. Since all these wires carry 24VAC, they must all be converted to 5VDC using well known and established circuits. The thermostat signals, once converted to 5VDC can be connected to an input port of the microprocessor. The microprocessor can then read these signals and determine the mode of the HVAC system. Provisions for a 9V battery and back-up circuit complete the power supply.

Also necessary is a means to input information about the HVAC system being monitored. A keypad and alphanumeric LCD display as is common on calculators and small instruments can be driven by the single board computer when configured according to the manufacturer's instructions. The microprocessor's memory must be of sufficient size to retain the HVAC information. An on-board single chip modem of the type made by various chip manufacturers can do the necessary communications. An FCC-approved Direct Access Arrangement will allow connection to the telephone network.

While the invention has been described with reference to a preferred and illustrative embodiments, it will be recognized that other variations, modifications, and other embodiments are contemplated, as being within the spirit and scope of the invention. The invention therefore is to be correspondingly broadly construed, with respect to such variations, modifications and other embodiments, as being within the spirit and scope of the invention as hereafter claimed.

What is claimed is:

1. An apparatus for monitoring the performance of an HVAC unit having a heating mode and a cooling mode operation, said apparatus comprising:

means for continuously monitoring air temperature and air humidity, the means for monitoring positioned to sense a real-time value for a supply air temperature, a return air temperature and a return air relative humidity for the HVAC unit, and responsively generating data outputs for said supply air temperature, said return air temperature and said return air relative humidity;

a monitor processing unit constructed and arranged to receive said data outputs for the real-time values for both return air temperature and return air relative humidity in addition to supply air temperature during a selected one of the heating mode and cooling mode operations and responsively establishing a corresponding correction factor, said correction factor representing a difference between a theoretical ideal performance operation of said HVAC unit and a best actual performance operation of said HVAC unit, and responsively establishing an adjustable operating range based on said correction factor; and means for inputting data defining a selected operating range for the HVAC unit encompassing the adjustable operating range;

said monitor processing unit being constructed and arranged to output a performance result of said HVAC unit when said HVAC unit operates outside the selected operating range.

2. The apparatus according to claim 1, wherein said means for inputting data comprises an input device connected to the monitor processing unit for entering input data, the input data comprising said supply air temperature, return air temperature and return air humidity of the HVAC unit under the theoretical ideal performance operation.

3. The apparatus according to claim 1, further comprising a means for transmitting said performance result to a remote location.

4. The apparatus according to claim 2, wherein said monitor processing unit responsively establishes said best actual performance operation of the HVAC unit from the data outputs of said supply air temperature, return air temperature and return air relative humidity when the HVAC unit is operating under best practicable conditions.

5. The apparatus according to claim 1, wherein the heating mode correction factor is a temperature value equal to the difference between a theoretical ideal temperature differential and a best actual temperature differential for a given return air temperature reading measured, respectively, by the supply air temperature and the return air temperature during the theoretical ideal performance operation of the HVAC unit and the best actual performance operation of the HVAC unit.

6. An apparatus for monitoring the performance of an HVAC unit having a heating mode and a cooling mode operation, said apparatus comprising:

means for monitoring air temperature and air humidity, the means for monitoring positioned to sense a value for a supply air temperature, a return air temperature and a return air relative humidity for the HVAC unit, and responsively generating data outputs for said supply air temperature, said return air temperature and said return air relative humidity;

a monitor processing unit constructed and arranged to receive said data outputs for the real-time values for both return air temperature and return air relative humidity in addition to supply air temperature during a selected one of the heating mode and cooling mode operations and responsively establishing a corresponding correction factor, said correction factor representing a difference between a theoretical ideal performance operation of said HVAC unit and a best actual performance operation of said HVAC unit, and responsively establishing an adjustable operating range based on said correction factor, wherein the heating mode correction factor is a temperature value equal to the difference between a theoretical ideal temperature differential and a best actual temperature differential for a given return air temperature reading measured, respectively, by the supply air temperature and the return air temperature during the theoretical ideal performance operation of the HVAC unit and the best actual performance operation of the HVAC unit; and means for inputting data defining a selected operating range for the HVAC unit encompassing the adjustable operating range, wherein the adjustable operating range is a temperature differential greater than the theoretical ideal temperature differential minus the correction factor for said given return air temperature reading;

said monitor processing unit being constructed and arranged to output a performance result of said HVAC unit when said HVAC unit operates outside the selected operating range.

7. The apparatus according to claim 6, wherein the selected operating range is a temperature differential equal to or greater than said operating range.

8. An apparatus for monitoring the performance of an HVAC unit having a heating mode operation, said apparatus comprising:

means for continuously monitoring air temperature and air humidity, the means for monitoring positioned to sense a real-time value for a supply air temperature, a return air temperature and a return air relative humidity for the HVAC unit, and responsively generating data outputs for said supply air temperature, said return air temperature and said return air relative humidity;

a monitor processing unit constructed and arranged to receive said data outputs for the real-time values for both return air temperature and return air relative humidity in addition to supply air temperature during a selected one of the heating mode and cooling mode operations and responsively establishing a corresponding correction factor, said correction factor representing a difference between a theoretical ideal performance operation of said HVAC unit and a best actual performance operation of said HVAC unit, and responsively establishing an adjustable operating range based on said correction factor, wherein the heating mode correction factor is a temperature value equal to the difference between a theoretical ideal temperature differential and a best actual temperature differential for a given return air temperature reading measured, respectively, by the supply air temperature and the return air temperature during the theoretical ideal performance operation of the HVAC unit and the best actual performance operation of the HVAC unit, wherein the ideal temperature differential is calculated according to an equation selected from the group consisting of:

for heat generated by electric:

$$\Delta T=(kW)(3193)/CFM,$$

wherein:

$\Delta T$ is the ideal temperature differential in degrees Fahrenheit, kW is a furnace capacity in kilo-Watts, CFM is a capacity of a fan of the HVAC unit in cubic feet of air per minute; and for heat generated by natural gas:

$$\Delta T=(BTU)(EFF)/(CFM)(1.08)$$

wherein:

$\Delta T$ is the ideal temperature differential in degrees Fahrenheit,

BTU is a furnace capacity in British thermal units for the HVAC unit,

EFF is an heat efficiency rating of the HVAC unit in percentage, and

CFM is a capacity of a fan of the HVAC unit in cubic feet of air per minute;

means for inputting data defining a selected operating range for the HVAC unit encompassing the adjustable operating range; and said monitor processing unit being constructed and arranged to output a performance result of said HVAC unit when said HVAC unit operates outside the selected operating range.

9. The apparatus according to claim 1, wherein the cooling mode correction factor is a temperature value equal to the difference between a theoretical ideal temperature differential and a best actual temperature differential for a given return air temperature and relative humidity reading measured, respectively, by the supply air temperature and the return air temperature during the theoretical ideal performance operation of the HVAC unit and the best actual performance operation of the HVAC unit.

10. An apparatus for monitoring the performance of an HVAC unit having a cooling mode operation, said apparatus comprising:

means for monitoring air temperature and air humidity, the means for monitoring positioned to sense a value for a supply air temperature, a return air temperature and a return air relative humidity for the HVAC unit, and responsively generating data outputs for said supply air temperature, said return air temperature and said return air relative humidity;

a monitor processing unit constructed and arranged to receive said data outputs for the real-time values for both return air temperature and return air relative humidity in addition to supply air temperature during a selected one of the heating mode and cooling mode operations and responsively establishing a corresponding correction factor, said correction factor representing a difference between a theoretical ideal performance operation of said HVAC unit and a best actual performance operation of said HVAC unit, and responsively establishing an adjustable operating range based on said correction factor, wherein the cooling mode correction factor is a temperature value equal to the difference between a theoretical ideal temperature differential and a best actual temperature differential for a given return air temperature and relative humidity reading measured, respectively, by the supply air temperature and the return air temperature during the theoretical ideal performance operation of the HVAC unit and the best actual performance operation of the HVAC unit; and means for inputting data defining a selected operating range for the HVAC unit encompassing the adjustable operating range, wherein the adjustable operating range is a temperature differential greater than the theoretical ideal temperature differential plus the correction factor for said given return air temperature and relative humidity; and said monitor processing unit being constructed and arranged to output a performance result of said HVAC unit when said HVAC unit operates outside the selected operating range.

11. The apparatus according to claim 10, wherein the selected operating range is a temperature differential equal to or greater than said operating range.

12. The apparatus according to claim 1, wherein the means for determining when the HVAC unit operates outside the selected operating range comprises a controller device which signals the monitor processing unit when said HVAC unit operates outside said selected operating range corresponding to the heating mode operation for a given return air temperature reading and corresponding to the cooling mode operation for a given return air temperature and relative humidity reading.

13. The apparatus according to claim 1, wherein the means for monitoring the supply air temperature comprises a supply air temperature probe proximate a supply air duct of said HVAC unit and the means for monitoring the return air temperature and return air relative humidity comprise, respectively, a return air temperature probe and a relative humidity probe proximate a return air duct of said HVAC unit, wherein said data outputs of said probes represent real-time analog readings of the air temperatures and relative humidity and said data outputs are converted from analog to digital form by an analog to digital converter.

14. The apparatus according to claim 3 wherein said means for transmitting a performance result of said HVAC unit comprises:

an alarm triggered by the monitor processing unit when the HVAC unit operates outside the selected operating mode established for the corresponding heating and cooling mode operations;

an HVAC telemeter connected to said alarm, telemetering the performance results, including identification and specification information for the HVAC unit; and a remote central station computer for receiving the performance results and identification and specification information wherein a repair and maintenance recommendation is prepared.

15. The apparatus according to claim 14 wherein said remote central station computer further comprises:

a database of repair and maintenance information for a multiplicity of HVAC units; and, a remote station telemeter for transferring the performance results, identification and specification information, and said repair and maintenance recommendation to a HVAC contractor located near the HVAC unit.

16. The apparatus according to claim 14 wherein said HVAC telemeter comprises a computer modem connection between the monitor processing unit and the central station computer.

17. The apparatus according to claim 15 wherein said remote station telemeter comprises a facsimile connection between the central station computer and the HVAC contractor.

18. An apparatus for monitoring the performance of an HVAC unit, comprising:

means for continuously monitoring a supply air temperature, a return air temperature and a return air relative humidity of the HVAC unit, said means for monitoring generating data outputs for said supply air temperature, said return air temperature and said return air relative humidity;

monitor processing unit having a microprocessor and a memory storage, said monitor processing unit linked to said means for monitoring to record and analyze said data outputs;

means for calibrating said monitor processing unit establishing an operating correction factor for said HVAC unit, said correction factor representing a difference between an ideal performance operation of said HVAC unit and an actual performance operation of said HVAC unit;

means for determining when said HVAC unit operates outside a desirable operating range;

a telemeter device for transmitting a performance result of said HVAC unit when it operates outside the selected operating range, said performance results comprising a periodic sampling of the supply air temperature, return air temperature and the return air relative humidity of the HVAC unit over a determined time period and an HVAC unit identification, specification and correction factor information for the HVAC unit; and a remote central station computer for diagnosing the performance result of the HVAC unit when the HVAC unit operates outside the selected operating range.

19. The apparatus according to claim 18, wherein the monitor processing unit comprises a microprocessor having memory storage.

20. The apparatus according to claim 18, wherein the input device comprises a keyboard for entering said input data into the monitor processing unit.

21. A method for monitoring the performance of an HVAC unit, comprising the steps of:

monitoring continuously a supply air temperature, a return air temperature and a return air relative humidity of the HVAC unit;

transmitting a plurality of output readings generated from the monitoring of temperatures and relative humidity of the HVAC unit;

calibrating a monitor processing unit that receives the output readings from the monitoring of temperatures and relative humidity, wherein a comparison is made between an actual operating range and an pre-selected operating range of the HVAC unit during a heating and cooling mode operation;

triggering an alarm when the HVAC unit is operating outside said pre-selected operating range;

telemetering the output readings and HVAC unit specifications to a remote central computer; and evaluating the output readings for determining recommended repairs and maintenance of the HVAC unit.

22. The method according to claim 21 wherein calibrating the monitor processing unit comprises the steps of:

inputting data comprising ideal input readings and best actual input readings of supply air temperature, return air temperature and relative humidity readings for the HVAC unit;

calculating a correction factor temperature differential under a heating mode operation and a cooling mode operation; and setting a heating mode tolerance point temperature differential and a cooling mode tolerance point temperature differential based on a desired tolerance from the corresponding heating or cooling mode correction factor temperature differential.

* * * * *

UNITED STATES PATENT AND TRADEMARK OFFICE

CERTIFICATE OF CORRECTION

PATENT NO. : 6,385,510 B1 
DATED : May 7, 2002
INVENTOR(S) : Klaus D. Hoog et al.

It is certified that error appears in the above-identified patent and that said Letters Patent is hereby corrected as shown below:

Title page,
Item [57], "22 Claims, 7 Drawing Sheets" should be -- 22 Claims, 10 Drawing Sheets --

Column 2,
Line 24, "meaningless. An" should be -- meaningless. ¶ An --

Column 8,
Line 64, "computer. Still" should be -- computer. ¶ Still --

Column 10,
Line 11, "circuits. The" should be -- circuits. ¶ The --

Signed and Sealed this

Eighth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,385,510 B1 
DATED : May 7, 2002
INVENTOR(S) : Klaus D. Hoog et al.

It is certified that error appears in the above-identified patent and that said Letters Patent is hereby corrected as shown below:

Delete the title page and substitute therefore the attached title page.

Delete Drawing Sheets 1-7 and substitute therefore the attached Drawing Sheets 1-10.

Signed and Sealed this

Twenty-sixth Day of August, 2003

JAMES E. ROGAN
*Director of the United States Patent and Trademark Office*

(12) United States Patent
Hoog et al.

(10) Patent No.: US 6,385,510 B1
(45) Date of Patent: May 7, 2002

(54) HVAC REMOTE MONITORING SYSTEM

(76) Inventors: Klaus D. Hoog, 914 Dacian Ave., Durham, NC (US) 27701-1702; Nims P. Knobloch, Jr., 1202 Transcontinental Dr., Metairle, LA (US) 70001

( * ) Notice: Subject to any disclaimer, the term of this patent is extended or adjusted under 35 U.S.C. 154(b) by 0 days.

(21) Appl. No.: 09/203,728

(22) Filed: Dec. 2, 1998

Related U.S. Application Data

(60) Provisional application No. 60/067,793, filed on Dec. 3, 1997.

(51) Int. Cl.[7] ..... G01M 1/38

(52) U.S. Cl. ..... 700/276; 700/204; 700/300; 379/102.05

(58) Field of Search ..... 700/276, 278, 700/108; 379/102.05

(56) References Cited

U.S. PATENT DOCUMENTS

| | | | | |
|---|---|---|---|---|
| 4,432,232 A | | 2/1984 | Brantley et al. | 62/129 |
| 4,611,470 A | | 9/1986 | Enstrom | 62/127 |
| 4,897,798 A | | 1/1990 | Cler | 364/505 |
| 5,259,553 A | | 11/1993 | Shyu | 236/49.3 |
| 5,386,461 A | | 1/1995 | Gedney | 379/102 |
| 5,592,058 A | * | 1/1997 | Archer et al. | 318/254 |
| 5,682,329 A | * | 10/1997 | Seem et al. | 700/276 |

* cited by examiner

*Primary Examiner*—William Grant
*Assistant Examiner*—Ronald D Hartman, Jr.
(74) *Attorney, Agent, or Firm*—Marianne Fuierer; Steven J. Hultquist

(57) ABSTRACT

An electronic HVAC monitoring computer continuously monitors the general condition and efficiency of an HVAC system and notifies a central station computer via modem link or other signal transmission means, when the general condition or efficiency of the HVAC system falls below certain industry standard values by a pre-set amount.

22 Claims, 10 Drawing Sheets

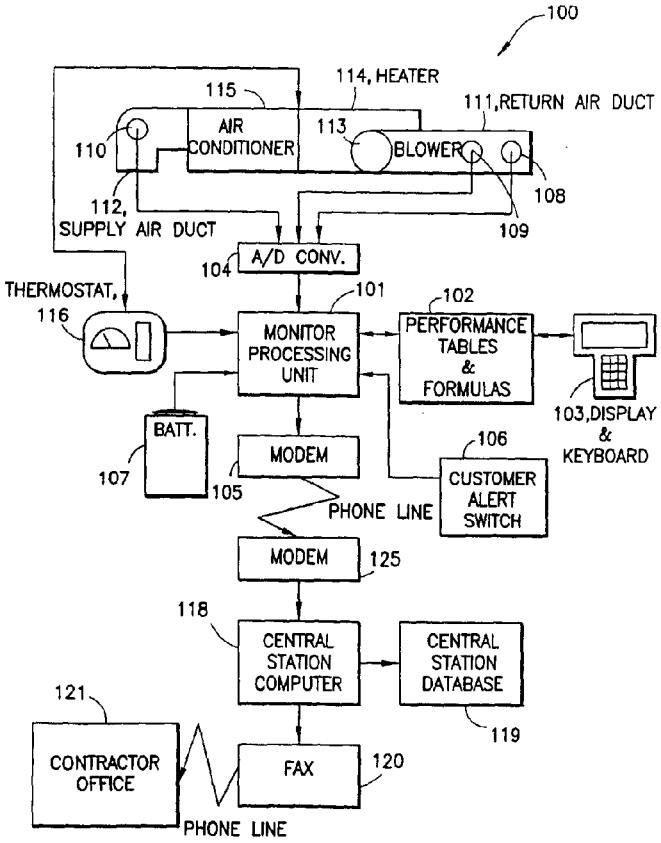

TABLE 1a

350 CFM/TON

| % RELATIVE HUMIDITY | 60 | 65 | 70 | 75 | 80 | 85 | 90 | DEG. F. |
|---|---|---|---|---|---|---|---|---|
| 95 | 13.6 | 12.3 | 11.1 | 10 | 9.1 | 8.2 | 7.4 | |
| 90 | 14.8 | 13.6 | 12.5 | 11.4 | 10.5 | 9.7 | 9 | |
| 85 | 16 | 14.9 | 13.8 | 12.9 | 12 | 11.3 | 10.6 | |
| 80 | 17.3 | 16.2 | 15.3 | 14.4 | 13.6 | 12.9 | 12.3 | |
| 75 | 18.5 | 17.6 | 16.7 | 15.9 | 15.2 | 14.6 | 14.1 | |
| 70 | 19.8 | 19 | 18.2 | 17.5 | 16.9 | 16.3 | 15.9 | |
| 65 | 21.1 | 20.4 | 19.7 | 19.1 | 18.6 | 18.2 | 17.8 | |
| 60 | 22.5 | 21.9 | 21.3 | 20.8 | 20.4 | 20 | 19.8 | |
| 55 | 23.8 | 23.3 | 22.9 | 22.5 | 22.2 | 22 | 21.8 | ΔT |
| 50 | 25.2 | 24.9 | 24.6 | 24.3 | 24.2 | 24 | 24 | |
| 45 | 26.7 | 26.5 | 26.3 | 26.2 | 26.1 | 26.2 | 26.2 | |
| 40 | 28.1 | 28.1 | 28.1 | 28.1 | 28.2 | 28.4 | 28.6 | |
| 35 | 29.6 | 29.7 | 29.9 | 30.1 | 30.3 | 30.7 | 31 | |
| 30 | 31.1 | 31.4 | 31.7 | 32.1 | 32.6 | 33.1 | 33.6 | |
| 25 | 32.7 | 33.1 | 33.7 | 34.2 | 34.9 | 35.6 | 36.3 | |
| 20 | 34.2 | 34.9 | 35.6 | 36.4 | 37.3 | 38.2 | 39.2 | |
| 15 | 35.8 | 36.7 | 37.7 | 38.7 | 39.8 | 41 | 42.2 | |
| 10 | 37.5 | 38.6 | 39.8 | 41 | 42.4 | 43.9 | 45.4 | |
| 5 | 39.2 | 40.5 | 41.9 | 43.5 | 45.1 | 46.9 | 48.8 | |

TABLE 1b

400 CFM/TON

| % RELATIVE HUMIDITY | 60 | 65 | 70 | 75 | 80 | 85 | 90 | DEG. F. |
|---|---|---|---|---|---|---|---|---|
| 95 | 11.9 | 10.8 | 9.7 | 8.8 | 8 | 7.2 | 6.6 | ΔT |
| 90 | 13 | 12 | 11 | 10.2 | 9.4 | 8.7 | 8.1 | |
| 85 | 14.2 | 13.2 | 12.4 | 11.6 | 10.9 | 10.3 | 9.7 | |
| 80 | 15.4 | 14.5 | 13.8 | 13.1 | 12.4 | 11.9 | 11.4 | |
| 75 | 16.6 | 15.8 | 15.2 | 14.5 | 14 | 13.5 | 13.1 | |
| 70 | 17.8 | 17.2 | 16.6 | 16.1 | 15.6 | 15.2 | 14.9 | |
| 65 | 19.1 | 18.6 | 18.1 | 17.7 | 17.3 | 17 | 16.8 | |
| 60 | 20.4 | 20 | 19.6 | 19.3 | 19 | 18.8 | 18.7 | |
| 55 | 21.7 | 21.4 | 21.2 | 21 | 20.8 | 20.7 | 20.7 | |
| 50 | 23.1 | 22.9 | 22.8 | 22.7 | 22.7 | 22.7 | 22.8 | |
| 45 | 24.4 | 24.4 | 24.4 | 24.5 | 24.6 | 24.8 | 25 | |
| 40 | 25.9 | 26 | 26.1 | 25.3 | 26.6 | 26.9 | 27.3 | |
| 35 | 27.3 | 27.6 | 27.9 | 28.3 | 28.7 | 29.1 | 29.7 | |
| 30 | 28.8 | 29.2 | 29.7 | 30.2 | 30.8 | 31.5 | 32.2 | |
| 25 | 30.2 | 30.9 | 31.4 | 32.3 | 33.1 | 33.9 | 34.8 | |
| 20 | 31.8 | 32.6 | 33.5 | 34.4 | 35.4 | 36.5 | 37.6 | |
| 15 | 33.3 | 34.3 | 35.4 | 36.6 | 37.8 | 39.1 | 40.5 | |
| 10 | 34.9 | 36.1 | 37.4 | 38.9 | 40.3 | 41.9 | 43.6 | |
| 5 | 36.5 | 38 | 39.5 | 41.2 | 43 | 44.8 | 46.8 | |

TABLE 1c

450 CFM/TON

| % RELATIVE HUMIDITY | 60 | 65 | 70 | 75 | 80 | 85 | 90 | DEG. F. |
|---|---|---|---|---|---|---|---|---|
| 95 | 10.5 | 9.6 | 8.7 | 7.9 | 7.2 | 6.5 | 6 | |
| 90 | 11.6 | 10.8 | 10 | 9.2 | 8.6 | 8 | 7.5 | |
| 85 | 12.8 | 12 | 11.3 | 10.6 | 10 | 9.5 | 9.1 | |
| 80 | 13.9 | 13.2 | 12.6 | 12 | 11.5 | 11.1 | 10.7 | |
| 75 | 15.1 | 14.5 | 14 | 13.5 | 13.1 | 12.7 | 12.4 | |
| 70 | 16.3 | 15.8 | 15.4 | 15 | 14.7 | 14.4 | 14.1 | |
| 65 | 17.6 | 17.2 | 16.8 | 16.5 | 16.3 | 16.1 | 16 | |
| 60 | 18.8 | 18.6 | 18.3 | 18.1 | 18 | 17.9 | 17.9 | |
| 55 | 20.1 | 20 | 19.8 | 19.8 | 19.7 | 19.8 | 19.8 | ΔT |
| 50 | 21.4 | 21.4 | 21.4 | 21.5 | 21.6 | 21.7 | 21.9 | |
| 45 | 22.8 | 22.9 | 23 | 23.2 | 23.4 | 23.7 | 24 | |
| 40 | 24.1 | 24.4 | 24.7 | 25 | 25.4 | 25.8 | 26.3 | |
| 35 | 25.5 | 25.9 | 26.4 | 26.9 | 27.4 | 28 | 28.6 | |
| 30 | 27 | 27.5 | 28.1 | 28.8 | 29.5 | 30.3 | 31.1 | |
| 25 | 28.4 | 29.2 | 30 | 30.8 | 31.7 | 32.6 | 33.6 | |
| 20 | 29.9 | 30.8 | 31.8 | 32.9 | 34 | 35.1 | 36.3 | |
| 15 | 31.4 | 32.5 | 33.7 | 35 | 36.3 | 37.7 | 39.2 | |
| 10 | 33 | 34.3 | 35.7 | 37.2 | 38.8 | 40.5 | 42.2 | |
| 5 | 34.5 | 36.1 | 37.7 | 39.5 | 41.3 | 43.3 | 45.4 | |